US011837788B2

(12) United States Patent
Nemoto et al.

(10) Patent No.: US 11,837,788 B2
(45) Date of Patent: Dec. 5, 2023

(54) ANTENNA DEVICE

(71) Applicant: Murata Manufacturing Co., Ltd., Nagaokakyo (JP)

(72) Inventors: Takaya Nemoto, Nagaokakyo (JP); Dai Futagami, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 337 days.

(21) Appl. No.: 17/213,256

(22) Filed: Mar. 26, 2021

(65) Prior Publication Data

US 2021/0226341 A1 Jul. 22, 2021

Related U.S. Application Data

(63) Continuation of application No. PCT/JP2019/033976, filed on Aug. 29, 2019.

(30) Foreign Application Priority Data

Sep. 27, 2018 (JP) ..... 2018-181163

(51) Int. Cl.
*H01Q 21/00* (2006.01)
*H01Q 5/378* (2015.01)
*H01Q 9/04* (2006.01)

(52) U.S. Cl.
CPC ..... *H01Q 21/0075* (2013.01); *H01Q 5/378* (2015.01); *H01Q 9/0407* (2013.01)

(58) Field of Classification Search
CPC ..... H01Q 15/08; H01Q 21/0075; H01Q 1/38; H01Q 5/378–385; H01Q 9/0407
See application file for complete search history.

(56) References Cited

U.S. PATENT DOCUMENTS 7,161,555 B2 * 1/2007 Ohno ..... H01Q 21/061 343/785
2010/0141517 A1 6/2010 Surittikul et al.
(Continued)

FOREIGN PATENT DOCUMENTS

EP 0280379 A2 8/1988
JP 63-224507 A 9/1988
(Continued)

OTHER PUBLICATIONS

International Search Report and Written Opinion dated Oct. 21, 2019, received for PCT Application PCT/JP2019/033976, Filed on Aug. 29, 2019, 6 pages including English Translation.
(Continued)

*Primary Examiner* — Hasan Islam
(74) *Attorney, Agent, or Firm* — XSENSUS LLP

(57) ABSTRACT

A feed element for feeding power is disposed on a substrate. A first parasitic element is disposed at a position different from a position of the feed element as viewed from above and is electromagnetically coupled with the feed element. A dielectric member is disposed at a position at which the dielectric member at least partially covers the feed element and the first parasitic element as viewed from above. A conductive pattern is disposed on a surface of the dielectric member which faces the feed element at a position at which the conductive pattern matches the first parasitic element as viewed from above. The dielectric member is supported by the substrate as a result of the conductive pattern being electrically connected to the first parasitic element.

16 Claims, 13 Drawing Sheets

(56) References Cited

U.S. PATENT DOCUMENTS

| | | | | |
|---|---|---|---|---|
| 2020/0328521 | A1* | 10/2020 | Rogers | H01Q 9/0442 |
| 2020/0328529 | A1* | 10/2020 | Rogers | H01Q 13/06 |

FOREIGN PATENT DOCUMENTS

| | | | |
|---|---|---|---|
| JP | 1-243605 | A | 9/1989 |
| JP | 7-162225 | A | 6/1995 |
| WO | 2017/003374 | A1 | 1/2017 |

OTHER PUBLICATIONS

Japanese Office Action dated Apr. 12, 2022, in corresponding Japanese Application No. 2020-548243.

* cited by examiner

ANTENNA DEVICE

CROSS-REFERENCE TO RELATED APPLICATIONS

The present application is a continuation of and claims priority to PCT/JP2019/033976, filed Aug. 29, 2019, which claims priority to JP 2018-181163, filed Sep. 27, 2018, the entire contents of each are incorporated herein by its reference.

TECHNICAL FIELD

The present disclosure relates to an antenna device.

BACKGROUND ART

A dielectric-loaded array antenna including plural patches formed on a substrate is known (see Patent Document 1). In the array antenna disclosed in Patent Document 1, a dielectric equivalent is disposed on each of the plural patches, thereby enhancing the aperture efficiency.

CITATION LIST

Patent Document

Patent Document 1: Japanese Unexamined Patent Application Publication No. H01-243605

SUMMARY

Technical Problems

Patent Document 1, as recognized by the present inventors, does not discuss a specific approach regarding how to fix the dielectric equivalents (dielectric members) to the substrate. The dielectric equivalents may be bonded to the substrate with an adhesive. In this approach, however, alignment is required to adjust the position of a dielectric equivalent to the associated patch (feed element). It is an object of the present disclosure to provide an antenna device which enables easy alignment to adjust the position of a dielectric member to a feed element.

Solution to Problem

According to an aspect of the present disclosure, there is provided an antenna device including a substrate, a feed element, a first parasitic element, a dielectric member, and a conductive pattern. The feed element is disposed on the substrate and is configured to provide power. The first parasitic element is disposed on the substrate at a position different from a position of the feed element as viewed from a plan view and is electromagnetically coupled with the feed element. The dielectric member is disposed at a position at which the dielectric member at least partially covers the feed element and the first parasitic element as viewed from the plan view. The conductive pattern is disposed on a surface of the dielectric member which faces the feed element and is located at a position at which the conductive pattern matches the first parasitic element as viewed from the plan view. The dielectric member is supported by the substrate as a result of the conductive pattern being electrically connected to the first parasitic element.

Advantageous Effects

As a result of aligning the conductive pattern to the first parasitic element, the position of the dielectric member is adjusted to the feed element. This enables easy alignment to adjust the position of the dielectric member to the feed element. Additionally, by the provision of the dielectric member, the operating band of the antenna device can be increased.

DESCRIPTION OF EMBODIMENTS

First Embodiment

An antenna device according to a first embodiment will be described below with reference to FIGS. 1A through 4C.

Figure 1A:
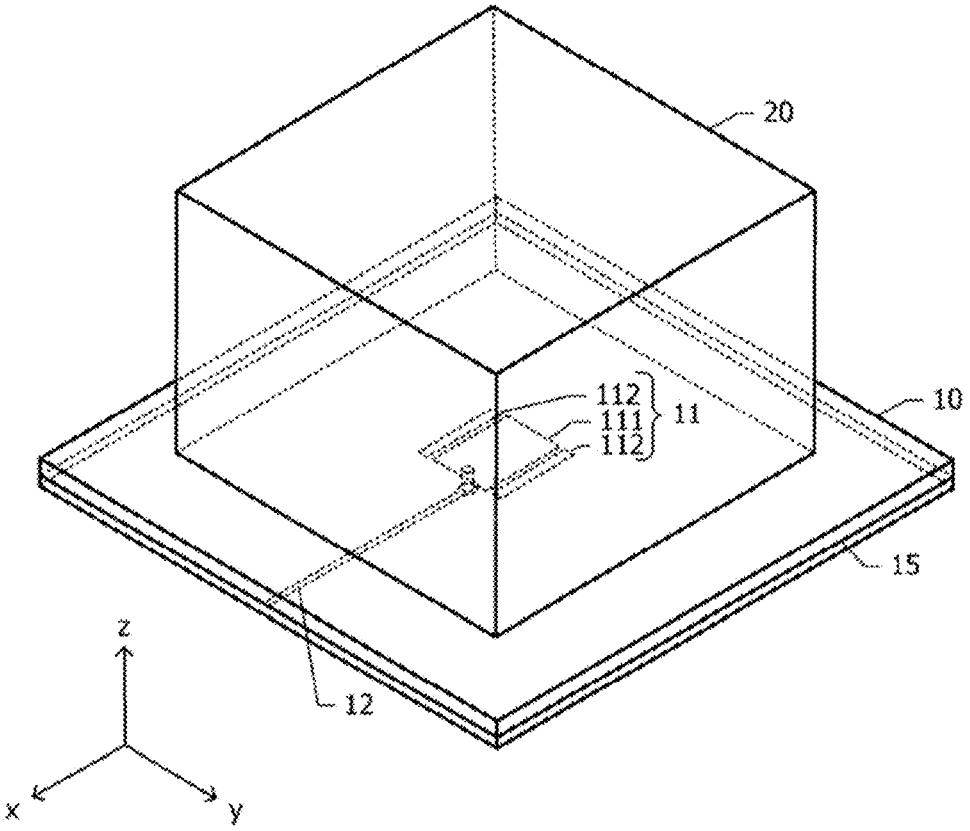
FIG. 1A is a perspective view of an antenna device according to a first embodiment.

FIG. 1A is a perspective view of the antenna device according to the first embodiment. A radiation element 11 is disposed on the top surface, which is one of the surfaces of a substrate 10 made of a dielectric material, while a ground conductor 15 is disposed on an inner layer of the substrate 10. The radiation element 11 and the ground conductor 15 form a patch antenna. The radiation element 11 is constituted by a feed element 111 and two first parasitic elements 112 (hereinafter simply called "parasitic elements"). The feed element 111 is formed in a rectangular planar shape. Details of the configuration of the radiation element 11 will be discussed later with reference to FIG. 1B.

A Cartesian coordinate system having xyz axes is defined as follows. The directions parallel with two adjacent sides of the feed element 111 are the x-axis direction and the y-axis direction. The direction of a normal line to the feed element 111 is the z-axis direction. The direction of the normal line to the feed element 111 (Z-axis direction) is defined as the height direction. A feed line 12 is provided on the bottom surface of the substrate 10. The feed line 12 is coupled with the feed element 111 by means of a via-hole within a clearance hole formed in the ground conductor 15 and extends on the positive side of the x axis from the portion coupled with the feed element 111.

A dielectric member 20 formed in a rectangular parallelepiped is disposed on the substrate 10 (on the side of the substrate 10 opposite the side on which the ground conductor 15 is disposed as viewed from the radiation element 11) so that it at least partially covers the radiation element 11 as viewed from above (plan view). The dielectric member 20 has a bottom surface parallel with the xy face, four side surfaces continuing to the four sides of the bottom surface, and a top surface parallel with the bottom surface. As viewed from above, the center of the bottom surface of the dielectric member 20 coincides with the center of the feed element 111. The bottom surface of the dielectric member 20 contains the radiation element 11 as viewed from above. The dielectric member 20 may be made of ceramics, such as low-temperature co-fired ceramics (LTCC), or a resin, such as polyimide. The relative permittivity εr of LTCC is about 6.4, while that of polyimide is about 3.

Figure 1B:
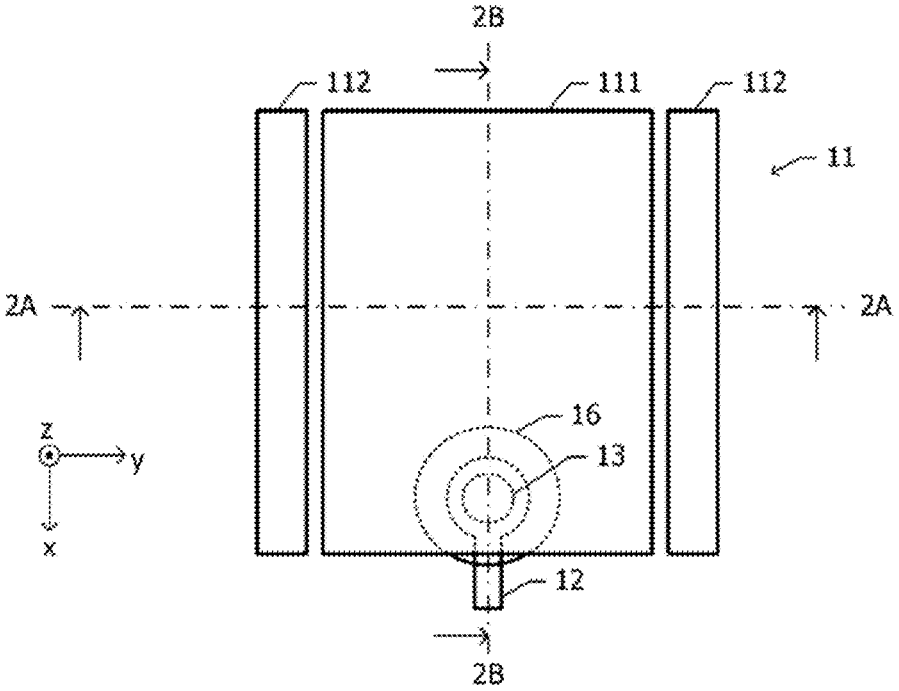
FIG. 1B is a plan view of a radiation element of the antenna device according to the first embodiment.

FIG. 1B is a plan view of the radiation element 11. The radiation element 11 includes the feed element 111 and the two parasitic elements 112. As viewed from above, the feed element 111 has a rectangular shape and has long sides parallel with the x axis. The parasitic elements 112 are disposed on both sides (on the positive and negative sides in the y-axis direction) of the feed element 111. The planar shape of each of the parasitic elements 112 is also a rectangle having long sides parallel with the x axis. A space is secured between the feed element 111 and each of the parasitic elements 112, and the parasitic elements 112 are electromagnetically coupled with the feed element 111. A via-conductor 13 is connected to the feed element 111 at a position on a line segment whose ends are at the midpoints of a pair of short sides of the feed element 111 perpendicular to the x axis. The via-conductor 13 is positioned toward one side from the center of this line segment. The connecting portion (feed point) of the feed element 111 and the via-conductor 13 may not necessarily be on this line segment. The feed line 12 may be connected to an edge of the feed element 111.

The via-conductor 13 extends from the feed element 111 to the bottom surface of the substrate 10 via a clearance hole 16 formed in the ground conductor 15 (FIG. 1A). The via-conductor 13 is connected to the feed line 12 provided on the bottom surface of the substrate 10. The feed line 12 extends from the portion connected to the via-conductor 13 in the positive direction of the x axis.

Figure 2A:
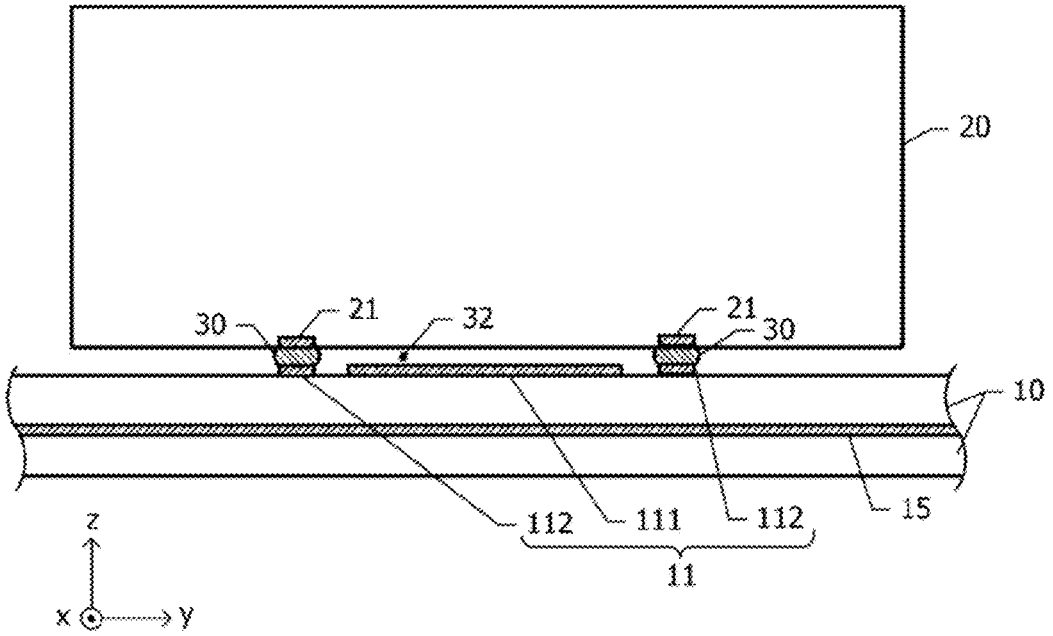
FIGS. 2A and 2B are sectional views taken along long dashed dotted lines 2A-2A and 2B-2B, respectively, in FIG. 1B.
Figure 2B:
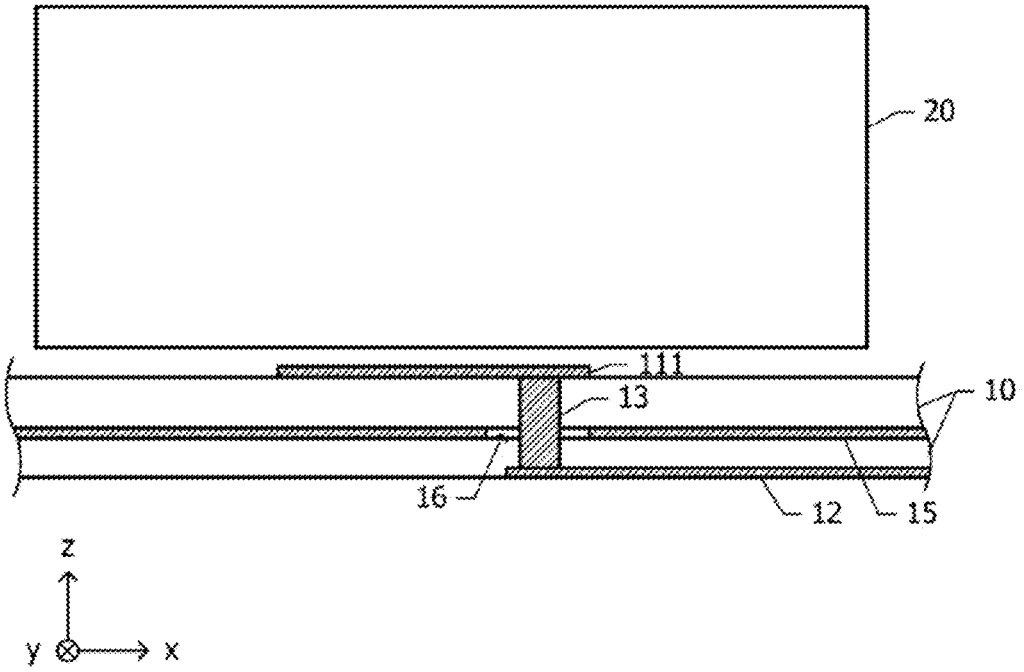

FIGS. 2A and 2B are sectional views taken along long dashed dotted lines 2A-2A and 2B-2B, respectively, in FIG. 1B. The radiation element 11 including the feed element 111 and the two parasitic elements 112 is disposed on the top surface of the substrate 10. The two parasitic elements 112 (FIG. 2A) are disposed on the top surface of the substrate 10 so as to sandwich the feed element 111 in the y-axis direction. The ground conductor 15 is disposed on the inner layer of the substrate 10, and the feed line 12 is disposed on the bottom surface of the substrate 10. The via-conductor 13 passes through the clearance hole 16 formed in the ground conductor 15 so as to connect the feed line 12 to the feed element 111.

Two conductive patterns 21 are provided on the bottom surface of the dielectric member 20. The two conductive patterns 21 are disposed at positions corresponding to the two parasitic elements 112 and are electrically connected to the two respective parasitic elements 112 via solder 30. As a result of the conductive patterns 21 being electrically connected to the parasitic elements 112 via the solder 30, the dielectric member 20 is supported by and fixed to the substrate 10. A gap 32 as large as a height of the solder 30 is secured between the dielectric member 20 and the feed element 111.

Advantages of the first embodiment will be discussed below.

Multi-resonance is generated by the feed element 111 and the parasitic elements 112 so as to increase the operating band of the antenna device. Additionally, because of the dielectric member 20 mounted on the radiation element 11, radio waves resonate within the dielectric member 20, thereby achieving an even wider band and an even higher gain.

The parasitic elements 112 serve as lands for fixing the dielectric member 20 to the substrate 10. Lands dedicated to fixing the dielectric member 20 are not required. This can prevent the degradation of the antenna performance caused by the provision of dedicated lands.

In the first embodiment, the gap 32 is secured between the dielectric member 20 and the substrate 10. Compared with the configuration in which the entirety of the bottom surface of the dielectric member 20 is bonded and fixed to the substrate 10 with an adhesive, for example, the area of the surface of the antenna device exposed to the air is increased, thereby enhancing the heat dissipation characteristics. Additionally, the parasitic elements 112 on the substrate 10 and the conductive patterns 21 on the dielectric member 20 oppose each other and are connected via the solder 30. This achieves easy alignment to adjust the position of the dielectric member 20 to the radiation element 11 during a mounting step of the dielectric member 20.

A simulation was conducted to verify the advantages of the first embodiment and will be explained below with reference to FIG. 3.

The dimensions in the x-axis direction and in the y-axis direction of the feed element 111 of the antenna device subjected to the simulation were 0.8 mm and 0.6 mm, respectively. The dimensions in the x-axis direction and in the y-axis direction of each of the parasitic elements 112 were 0.8 mm and 0.1 mm, respectively. The distance between the feed element 111 and each parasitic element 112 was 0.03 mm. The dimensions in the x-axis direction and in the y-axis direction of the dielectric member 20 were both 3.5 mm, and the height was 2.5 mm. The relative permittivity Er of the dielectric member 20 and the substrate 10 was 6.4. The thickness of the feed element 111, the parasitic elements 112, and the ground conductor 15 was 15 μm. The thickness of the substrate 10 between the feed element 111 and the ground conductor 15 was 100 μm, and the thickness of the substrate 10 under the ground conductor 15 was 65

μm. In the simulation, no gap 32 was provided between the feed element 111 and the dielectric member 20.

Figure 3:
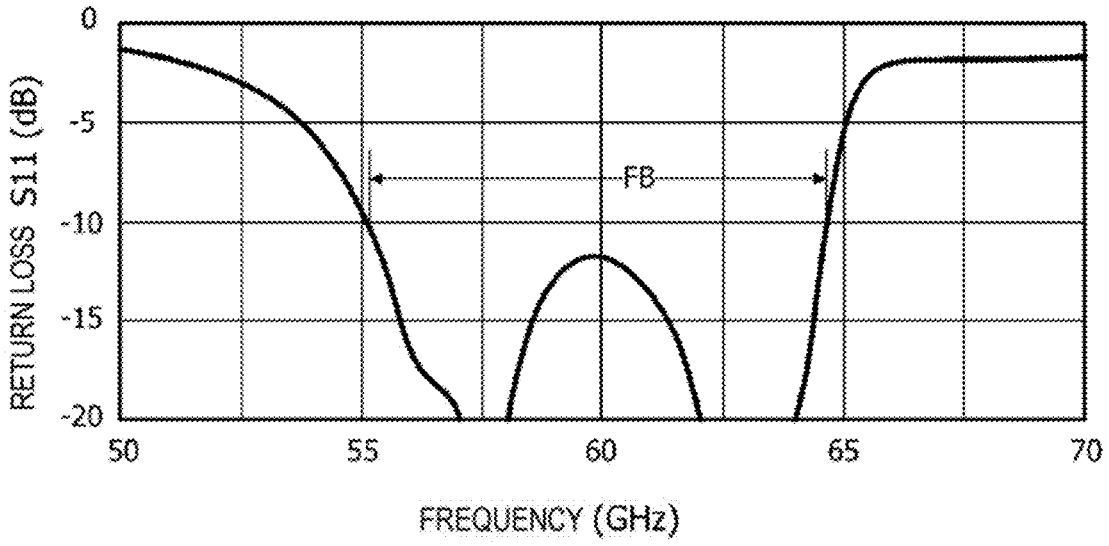
FIG. 3 is a graph illustrating the results of a simulation regarding return loss S11 of the antenna device according to the first embodiment.

FIG. 3 is a graph illustrating the simulation results of the return loss S11. The horizontal axis indicates the frequency by the unit "GHz", while the vertical axis indicates the return loss S11 by the unit "dB". In this specification, the range in which the return loss S11 is lower than or equal to −10 dB is assumed as an operating band FB. The graph shows that the operating band FB is in a range of about 55.1 to 64.7 GHz and a bandwidth of about 9.6 GHz is realized.

A simulation was conducted to ensure the advantage of a wider band obtained by the provision of the dielectric member 20 and will be explained below with reference to FIGS. 4A through 4C.

Figure 4A:
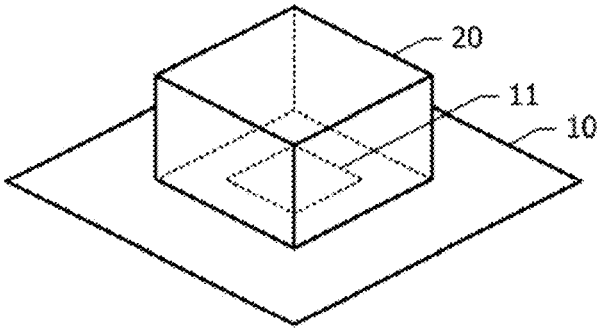
FIGS. 4A and 4B are perspective views of samples subjected to the simulation.
Figure 4B:
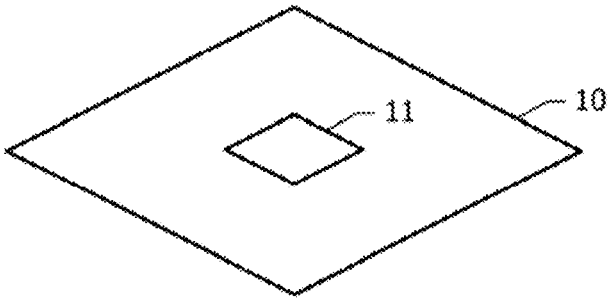

FIGS. 4A and 4B are perspective views of samples subjected to the simulation. In these samples, a feed element was only used as the radiation element 11 and no parasitic element was disposed. The sample shown in FIG. 4A includes a substrate 10, a radiation element 11, and a dielectric member 20 formed in the shape of a rectangular parallelepiped. The sample shown in FIG. 4B includes a substrate 10 and a radiation element 11 and a dielectric member is not disposed. The radiation element 11 was formed in a square shape, each side of which was 0.8 mm. The dimensions of the dielectric member 20 were optimized to maximize the operating bandwidth.

Figure 4C:
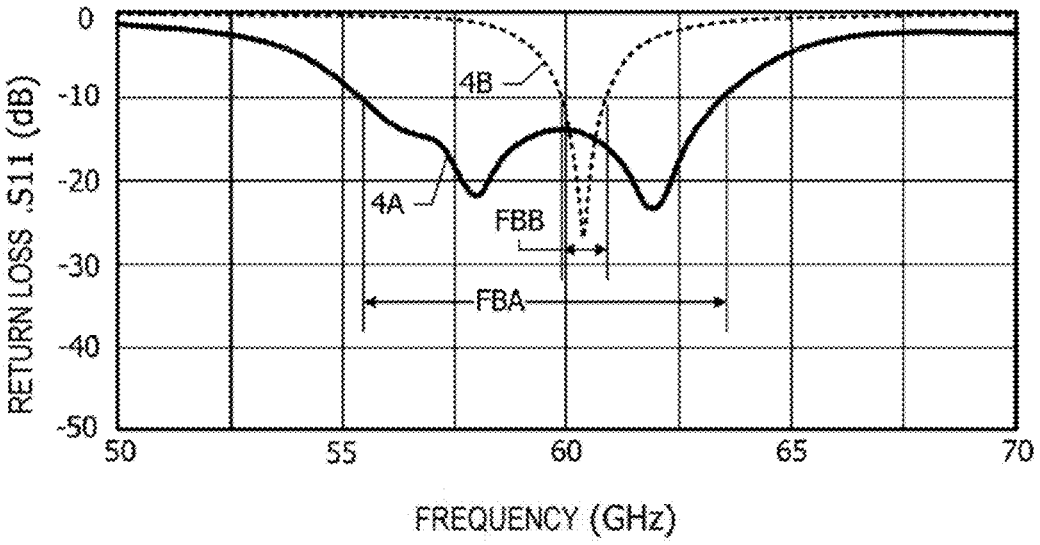
FIG. 4C is a graph illustrating the simulation results of the return loss S11 of the samples shown in FIGS. 4A and 4B.

FIG. 4C is a graph illustrating the simulation results of the return loss S11. The horizontal axis indicates the frequency by the unit "GHz", while the vertical axis indicates the return loss S11 by the unit "dB". A solid line 4A and a broken line 4B in the graph of FIG. 4C respectively indicate the return loss S11 of the sample shown in FIG. 4A and that in FIG. 4B. The operating bandwidth FBA of the sample shown in FIG. 4A is wider than the operating bandwidth FBB of the sample shown in FIG. 4B. It is validated from the simulation results that a wider band is achieved by the provision of the dielectric member 20.

It can be assumed from the simulation results shown in FIGS. 4A through 4C that a wider band is also achieved by the provision of the dielectric member 20 in the first embodiment in which the parasitic elements 112 (FIGS. 1A and 1B) are disposed.

Another simulation will be discussed below with reference to FIGS. 5 through 6B.

Figure 5:
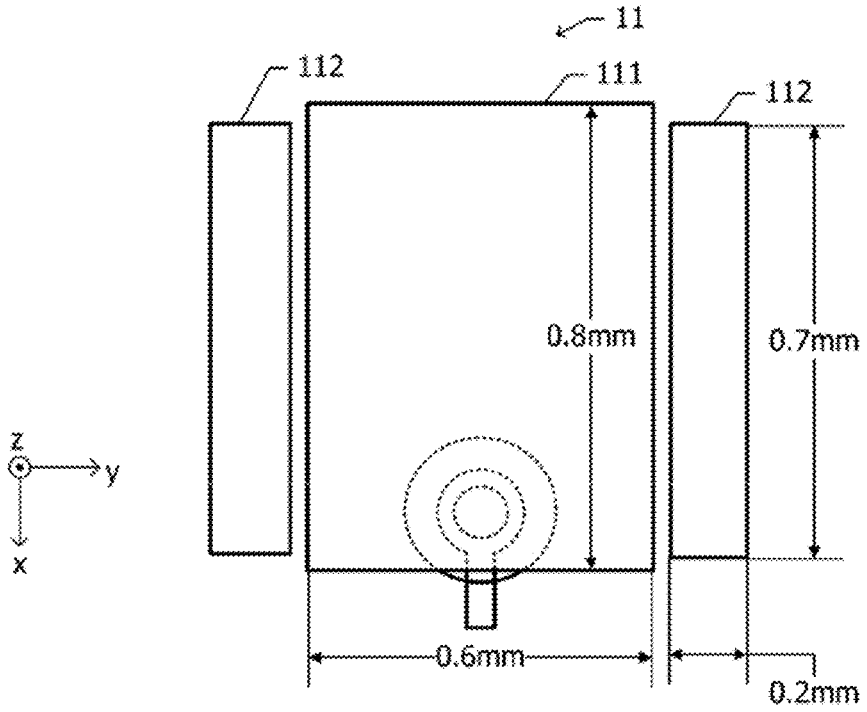
FIG. 5 is a plan view of a radiation element of a sample subjected to a simulation.

FIG. 5 is a plan view of the radiation element 11 of a sample subjected to a simulation. The dimensions of the feed element 111 are the same as those of the feed element 111 of the sample in the simulation shown in FIG. 3. In this different simulation, the dimension (length) of the parasitic element 112 in the x-axis direction is smaller than that of the sample in the simulation in FIG. 3, while the dimension (width) of the parasitic element 112 in the y-axis direction is larger than that of the sample in the simulation in FIG. 3. More specifically, the dimension of the parasitic element 112 in the x-axis direction was 0.7 mm, and that in the y-axis direction was 0.2 mm. The distance between the feed element 111 and each parasitic element 112 was 0.05 mm.

The bottom surface of the rectangular-parallelepiped dielectric member 20 (FIG. 1A) to be mounted on the radiation element 11 was formed in a square shape, each side of which was 1.5 mm. The height of the dielectric member 20 was 0.75 mm.

Figure 6A:
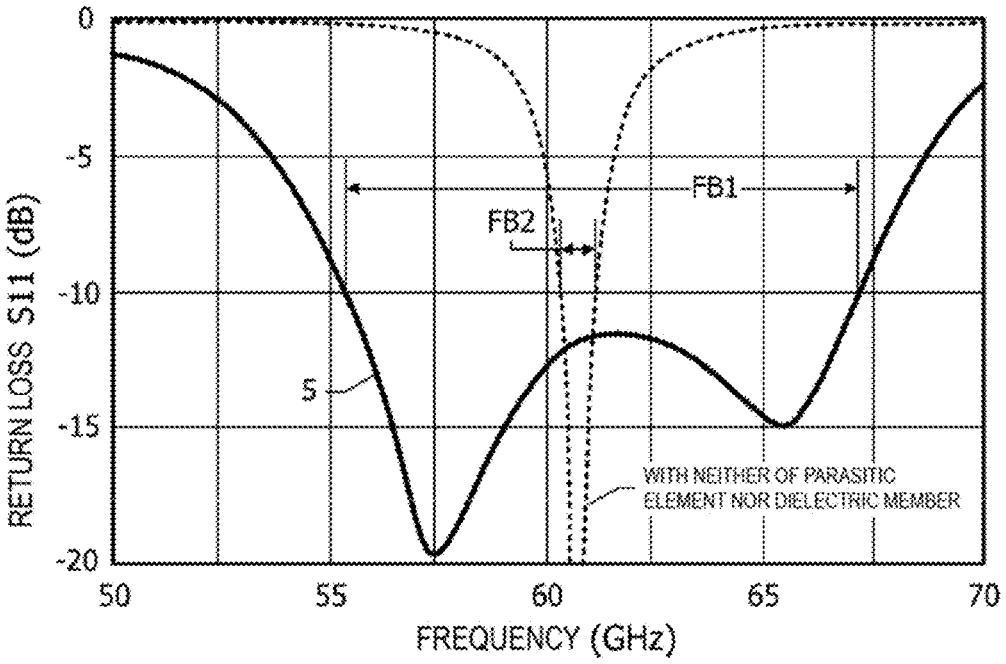
FIGS. 6A and 6B are graphs illustrating the simulation results of the return loss S11 and the antenna gain, respectively, of the sample shown in FIG. 5.
Figure 6B:
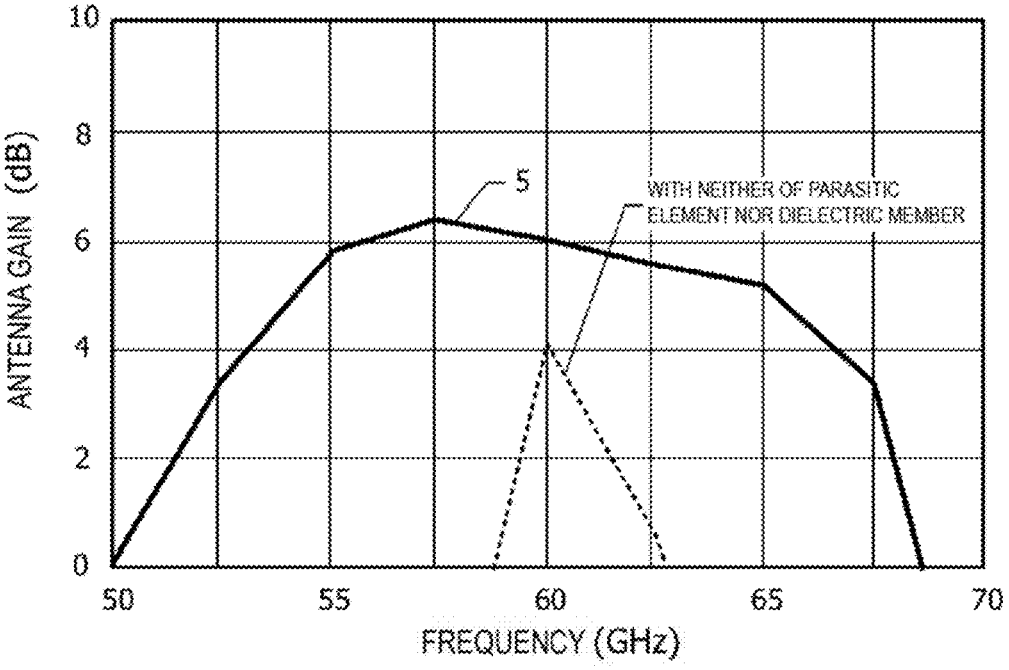

FIGS. 6A and 6B are graphs illustrating the simulation results of the return loss S11 and the antenna gain, respectively, of the sample shown in FIG. 5. The horizontal axes in FIGS. 6A and 6B indicate the frequency by the unit "GHz". The vertical axis in FIG. 6A indicates the return loss S11 by the unit "dB", and that in FIG. 6B indicates the antenna gain by the unit "dB". Solid lines 5 in the graphs of FIGS. 6A and 6B represent the simulation results of the sample shown in FIG. 5. The broken lines in the graphs represent the simulation results of a sample in which neither of the parasitic element 112 nor the dielectric member 20 is disposed.

It is seen from FIG. 6A that the operating band FB1 of the antenna device with the parasitic elements 112 and the dielectric member 20 is wider than the operating band FB2 of the antenna device with neither of a parasitic element nor a dielectric member. It is also seen from FIG. 6B that a higher gain is achieved by disposing the parasitic elements 112 and the dielectric member 20.

Modified examples of the first embodiment will be described below.

In the first embodiment, the dielectric member 20 is fixed to the substrate 10 with the solder 30. However, another conductive member may be used to fix the dielectric member 20. Although in the first embodiment the dielectric member 20 is formed in a rectangular parallelepiped, it may be formed in another shape. Various shapes of the dielectric member 20 will be discussed below in second and subsequent embodiments.

Second Embodiment

An antenna device according to a second embodiment will be described below with reference to FIGS. 7A and 7B. An explanation of the elements configured in the same manner as the antenna device of the first embodiment shown in FIGS. 1A through 2B will be omitted.

Figure 7A:
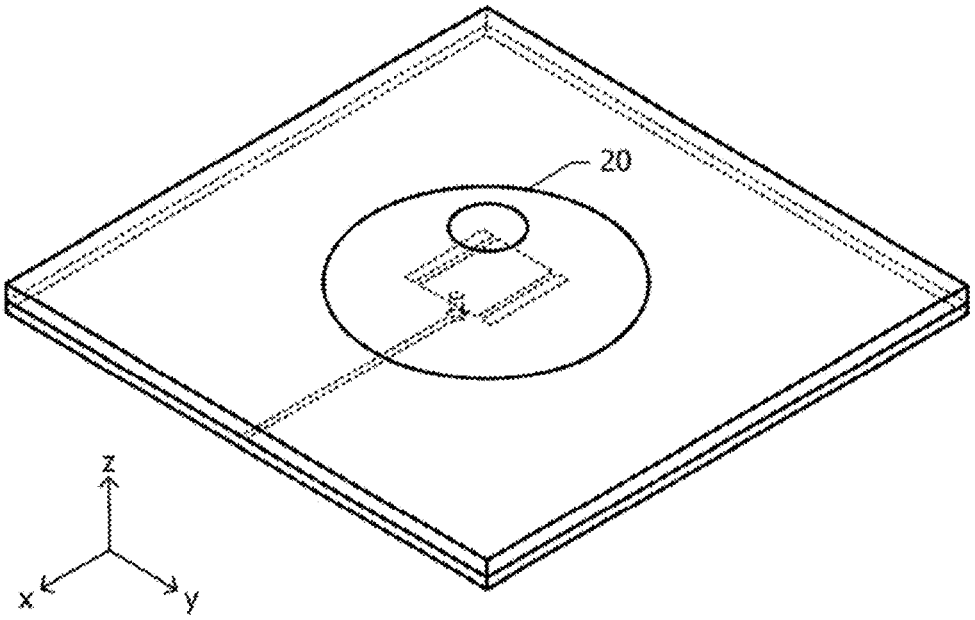
FIGS. 7A and 7B are a perspective view and a sectional view, respectively, of an antenna device according to a second embodiment.
Figure 7B:
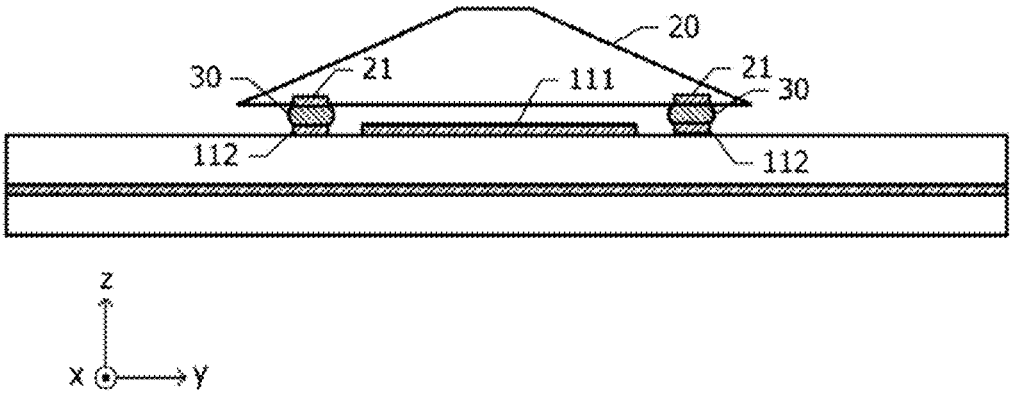

FIGS. 7A and 7B are a perspective view and a sectional view, respectively, of the antenna device according to the second embodiment. In the first embodiment, the dielectric member 20 is formed in a rectangular parallelepiped. In the second embodiment, the dielectric member 20 is formed in the shape of a truncated cone. Conductive patterns 21 are disposed on the circular bottom surface of the dielectric member 20 at positions corresponding to the parasitic elements 112. The conductive patterns 21 are connected to the parasitic elements 112 with solder 30.

The simulation conducted by the inventors of the disclosure of this application shows that a wider band is achieved by forming the dielectric member 20 in a truncated cone than that of the dielectric member 20 formed in a rectangular parallelepiped.

Modified examples of the second embodiment will be described below with reference to FIGS. 8A through 8C.

Figure 8A:
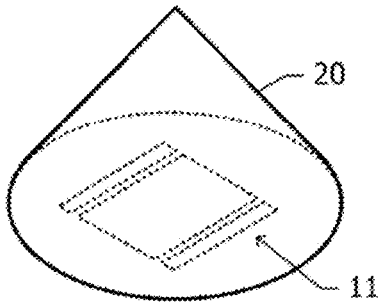
FIGS. 8A, 8B, and 8C are perspective views of dielectric members and radiation elements used in antenna devices according to modified examples of the second embodiment.
Figure 8B:
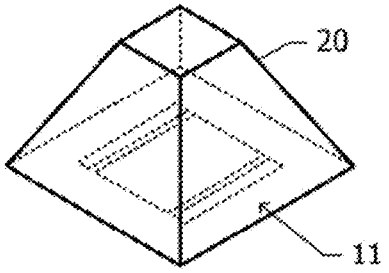
Figure 8C:
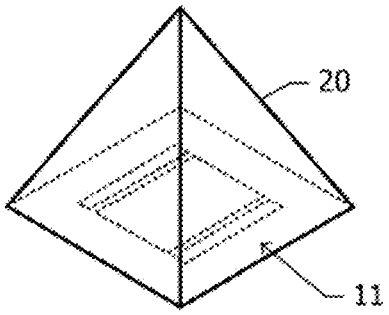

FIGS. 8A, 8B, and 8C are perspective views of dielectric members 20 and radiation elements 11 used in antenna devices according to the modified examples of the second embodiment. In the modified examples shown in FIGS. 8A, 8B, and 8C, the dielectric member 20 is formed in the shape of a cone, a truncated square pyramid, and a square pyramid, respectively.

The dielectric member 20 (FIGS. 7A and 7B) of the second embodiment and the dielectric members 20 of the modified examples shown in FIGS. 8A, 8B, and 8C have a rotationally symmetrical configuration about the axis parallel with the direction of a normal line to the feed element 111 as the rotation center. In the second embodiment and the modified example shown in FIG. 8A, the dielectric member 20 has a circularly symmetrical configuration. In the modified examples shown in FIGS. 8B and 8C, the dielectric member 20 has four-order symmetry characteristics. In any of the dielectric members 20, the side surfaces tilt with respect to the top surface of the feed element 111.

In this manner, it is possible to find the optimal shape of a dielectric member 20 that achieves a wider band than the dielectric member 20 formed in a rectangular parallelepiped as a result of forming a dielectric member 20 to have a rotationally symmetrical configuration and also to have an oblique side surface. Additionally, by adjusting the shape and the permittivity of the dielectric member 20 to be mounted on the radiation element 11, the operating bandwidth and the gain of the antenna device can be changed. This increases the flexibility in antenna designing.

Third Embodiment

An antenna device according to a third embodiment will be described below with reference to FIGS. 9A, 9B, and 9C. An explanation of the elements configured in the same manner as the antenna device of the first embodiment shown in FIGS. 1A through 2B will be omitted.

Figure 9A:
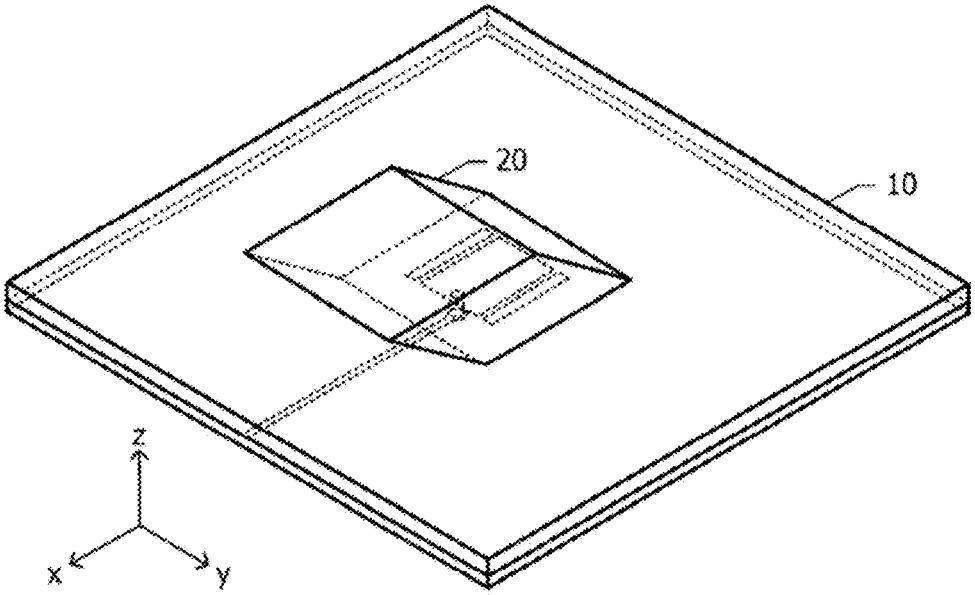
FIG. 9A is a perspective view of an antenna device according to a third embodiment.
Figure 9B:
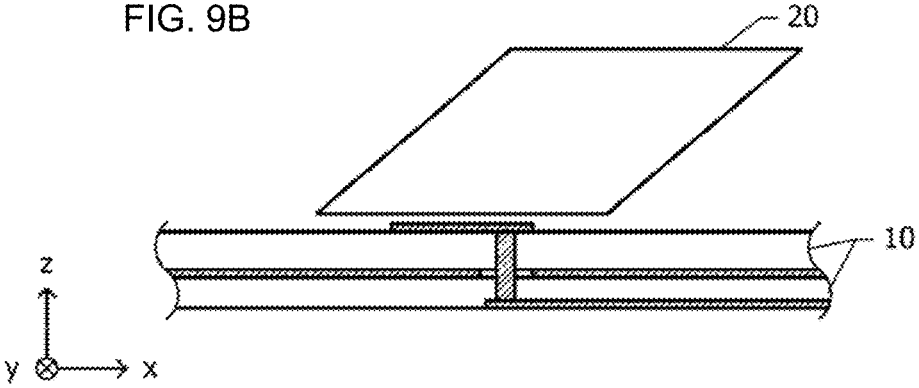
FIGS. 9B and 9C are sectional views of the antenna device according to the third embodiment parallel with an xz face and a yz face, respectively.
Figure 9C:
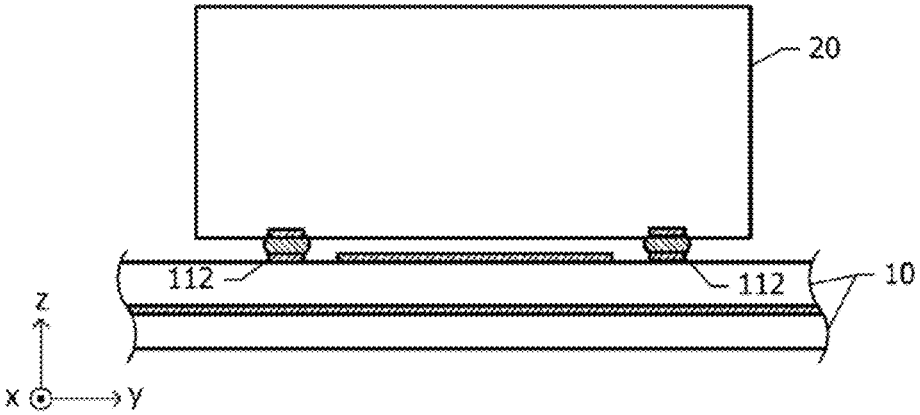

FIG. 9A is a perspective view of the antenna device according to the third embodiment. FIGS. 9B and 9C are sectional views of the antenna device according to the third embodiment parallel with the xz face and the yz face, respectively. In the first embodiment, the dielectric member 20 is formed in a rectangular parallelepiped. In the second embodiment, the dielectric member 20 is formed in the shape of a parallelepiped and at least two side surfaces parallel with each other are parallelograms having vertices each forming an angle other than 90°. In the third embodiment, two side surfaces parallel with the xz face are parallelograms, while the other two side surfaces are rectangles. A cross section of the dielectric member 20 parallel with the xz face is a parallelogram, as shown in FIG. 9B, while that parallel with the yz face is a rectangle, as shown in FIG. 9C.

A line linking the centers of horizontal sectional surfaces (parallel with the xy face) of the dielectric member 20 in the height direction (hereinafter such a line will be called a center line) leans with respect to the direction of a normal line to the feed element 111 (z-axis direction). The orientation in which the center line of the dielectric member 20 leans from the z-axis direction in the xy face will be called the orientation of tilt. In the third embodiment, the orientation of tilt corresponds to the positive direction of the x axis.

Advantages of the third embodiment will be discussed below. In the third embodiment, too, the parasitic elements 112 (FIG. 9C) provided on the substrate 10 serve as lands for fixing the dielectric member 20. Advantages similar to those of the first embodiment can thus be obtained.

Additionally, in the third embodiment, a beam of radio waves radiated from the antenna device tilts in the orientation of tilt with respect to the direction of a normal line to the feed element 111 (with respect to the direction directly in front of the feed element 111). In this manner, in the third embodiment, the antenna gain can be maximized in a direction leaning from the direction directly in front of the feed element 111. The direction in which the antenna gain is maximized can be changed by adjusting the orientation of tilt and the angle at which the center line of the dielectric member 20 leans from the direction of a normal line. As a result of adjusting the shape and the permittivity of the dielectric member 20 to be mounted on the radiation element 11, the direction in which the antenna gain is maximized is changed. This increases the flexibility in antenna designing.

An antenna device according to a modified example of the third embodiment will be described below with reference to FIGS. 10A, 10B, and 10C.

Figure 10A:
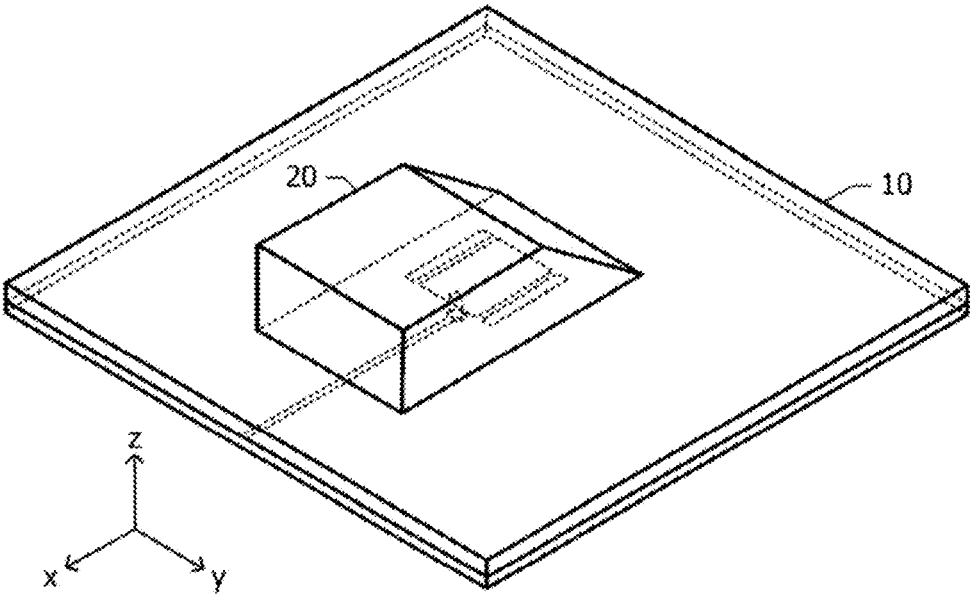
FIG. 10A is a perspective view of an antenna device according to the modified example of the third embodiment.

FIG. 10A is a perspective view of the antenna device according to the modified example of the third embodiment. FIGS. 10B and 10C are sectional views of the antenna device according to the modified example of the third embodiment parallel with the xz face and the yz face, respectively. In the third embodiment, the two side surfaces of the dielectric member 20 parallel with the xz face are parallelograms. In the modified example, the two side surfaces of the dielectric member 20 parallel with the xz face are each formed in a trapezoidal shape whose one leg is perpendicular to the bottom surface. That is, a cross section of the dielectric member 20 parallel with the xz face is a trapezoid whose one leg is perpendicular to the bottom surface, as shown in FIG. 10B. A cross section of the dielectric member 20 parallel with the yz face is a rectangle, as shown in FIG. 10C. In other words, one side surface of the dielectric member 20 is an oblique surface forming an angle smaller than 90 degrees with the bottom surface, and the side surface opposing this oblique surface forms a right angle with the bottom surface.

In the modified example, too, the center line of the dielectric member 20 leans with respect to the direction of a normal line to the feed element 111. Hence, as in the third embodiment, a beam of radio waves radiated from the antenna device tilts in the orientation of tilt with respect to the direction of a normal line to the feed element 111 (with respect to the direction directly in front of the feed element 111).

Another modified example of the third embodiment will be discussed below. In the third embodiment shown in FIGS. 9A, 9B, and 9C, a pair of side surfaces of the dielectric member 20 formed in a parallelepiped are perpendicular to the xy face. However, these side surfaces may be tilted. With this arrangement, the orientation of tilt of the dielectric member 20 is not limited to the positive direction of the x axis and faces in a desired direction in the xy face.

Figure 10B:
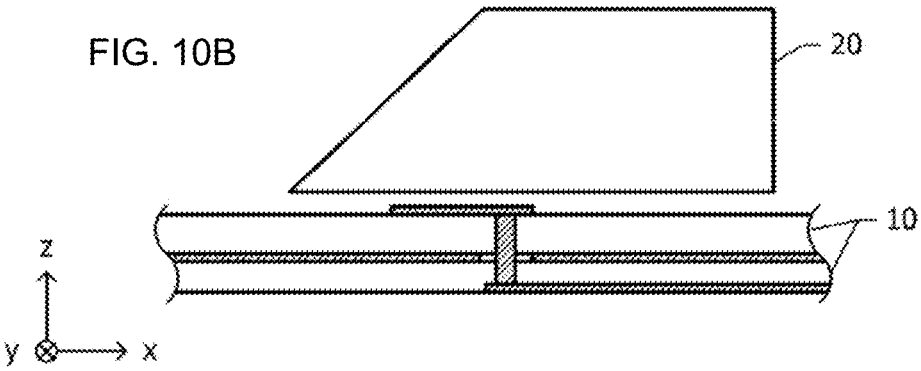
FIGS. 10B and 10C are sectional views of the antenna device according to the modified example of the third embodiment parallel with the xz face and the yz face, respectively.
Figure 10C:
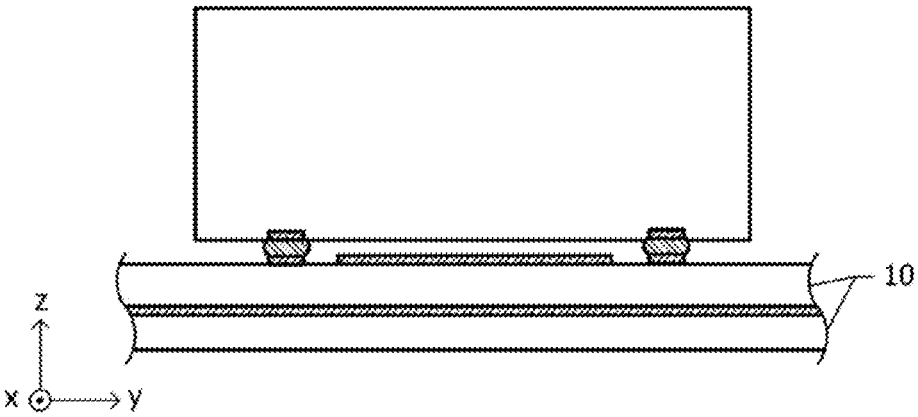

In the modified example shown in FIGS. 10A, 10B, and 10C, the side surface parallel with the xz face is a trapezoid whose one leg is perpendicular to the bottom surface. Alternatively, two legs may be tilted with respect to the bottom surface. Moreover, the dielectric member 20 may be formed in a parallelepiped whose bottom surface has a quadrilateral shape other than a rectangle, and at least one of the sectional surfaces perpendicular to the bottom surface is a trapezoid.

Fourth Embodiment

An antenna device according to a fourth embodiment will be described below with reference to FIGS. 11A and 11B. An explanation of the elements configured in the same manner as the antenna device of the first embodiment shown in FIGS. 1A through 2B will be omitted.

Figure 11A:
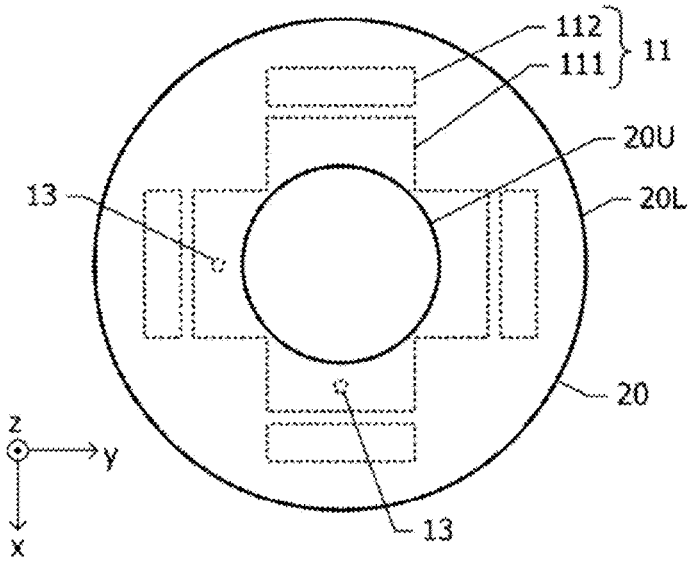
FIG. 11A is a plan view of a dielectric member and a radiation element of an antenna device according to a fourth embodiment.

FIG. 11A is a plan view of a dielectric member 20 and a radiation element 11 of the antenna device according to the fourth embodiment. In the first embodiment, the two parasitic elements 112 are coupled with the single feed element 111, as shown in FIG. 1B. In contrast, in the fourth embodiment, four parasitic elements 112 are coupled with a single feed element 111. The feed element 111 is formed in a cross shape in which a rectangle elongated in the x-axis direction and a rectangle elongated in the y-axis direction overlap each other with their centers matching each other.

A parasitic element 112 is disposed adjacent to each of the two short sides of the rectangle elongated in the x-axis direction with a gap therebetween. Likewise, a parasitic element 112 is disposed adjacent to each of the two short sides of the rectangle elongated in the y-axis direction with a gap therebetween. A via-conductor 13 is connected to each of the two intersecting rectangles at a position slightly inward from a midpoint of one of the short sides of each rectangle.

The dielectric member 20 is formed in the shape of a truncated cone. The center of a bottom surface 20L and that of a top surface 20U of the dielectric member 20 coincide with the center of the feed element 111, as viewed from above. The radiation element 11 is contained in the bottom surface of the dielectric member 20 as viewed from above.

Figure 11B:
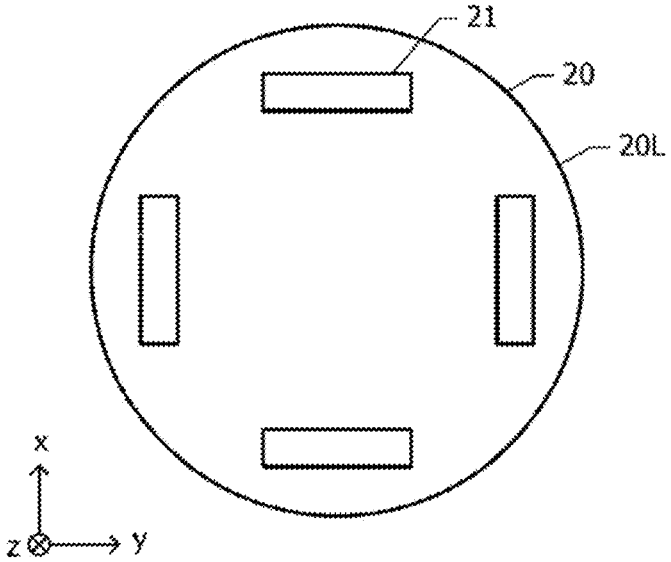
FIG. 11B is a bottom view of the dielectric member in the fourth embodiment.

FIG. 11B is a bottom view of the dielectric member 20 in the fourth embodiment. Four conductive patterns 21 are provided on the bottom surface 20L of the dielectric member 20. The four conductive patterns 21 are disposed at positions corresponding to the parasitic elements 112. As a result of connecting the four conductive patterns 21 to the four respective parasitic elements 112 via solder, for example, the dielectric member 20 is fixed to the substrate 10 (FIGS. 1A and 1B).

Advantages of the fourth embodiment will be discussed below. In the fourth embodiment, the feed element 111 can be excited both in the x-axis direction and in the y-axis direction. Moreover, the dielectric member 20 is fixed at four portions to the substrate 10, thereby enhancing the mounting strength of the dielectric member 20 to the substrate 10.

Fifth Embodiment

An antenna device according to a fifth embodiment will be described below with reference to FIG. 12. An explanation of the elements configured in the same manner as the antenna device of the first embodiment shown in FIGS. 1A through 2B will be omitted.

Figure 12:
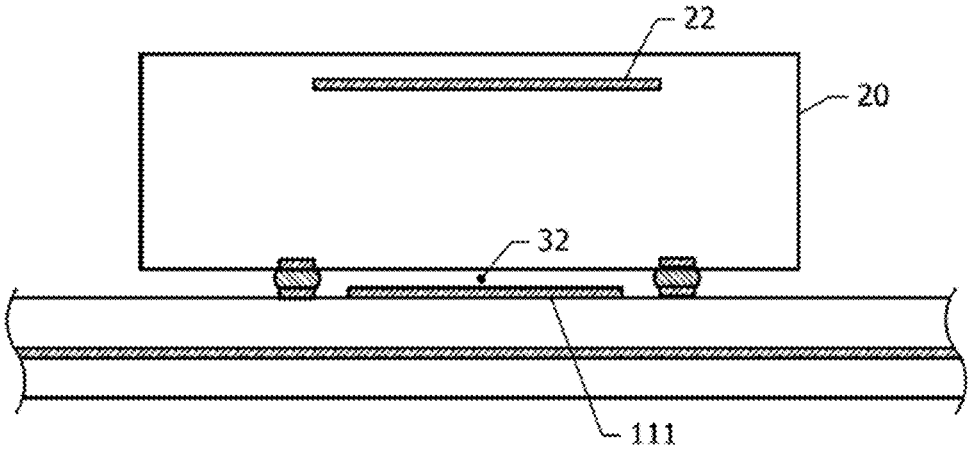
FIG. 12 is a sectional view of an antenna device according to a fifth embodiment.

FIG. 12 is a sectional view of the antenna device according to the fifth embodiment. In the fifth embodiment, a second parasitic element 22 is disposed within the dielectric member 20. The second parasitic element 22 is constituted by a conductive pattern disposed in the dielectric member 20. The second parasitic element 22 is electromagnetically coupled with the feed element 111 disposed on the substrate 10. The second parasitic element 22 may be disposed on the top surface of the dielectric member 20.

In the fifth embodiment, multi-resonance is generated by the second parasitic element 22, thereby achieving an even wider band. Additionally, a gap 32 is provided between the dielectric member 20 and the feed element 111. This means that the gap 32 also intervenes between the second parasitic element 22 within the dielectric member 20 and the feed element 111. This weakens capacitive coupling between the feed element 111 and the second parasitic element 22, compared with the configuration in which a dielectric fills a space between the feed element 111 and the second parasitic element 22. As a result, the effect of increasing the operating bandwidth is enhanced.

Sixth Embodiment

An antenna device according to a sixth embodiment will be described below with reference to FIG. 13. An explanation of the elements configured in the same manner as the antenna device of the first embodiment shown in FIGS. 1A through 2B will be omitted.

Figure 13:
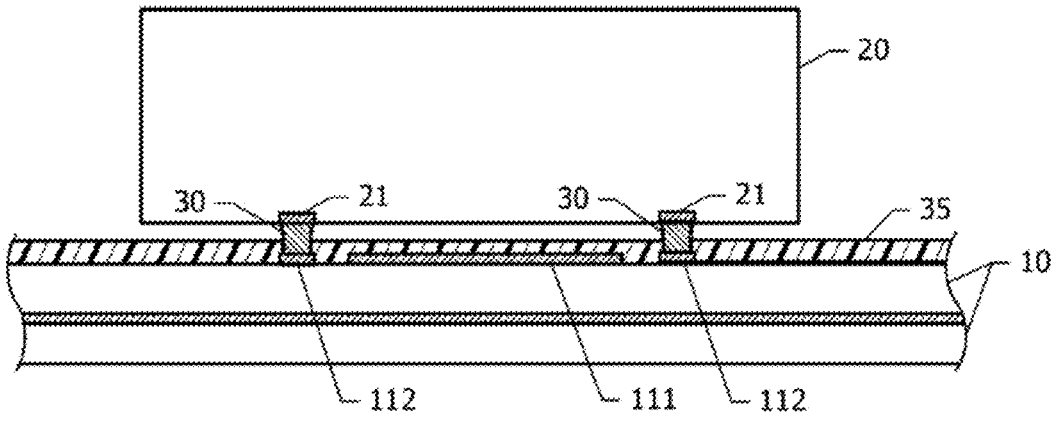
FIG. 13 is a sectional view of an antenna device according to a sixth embodiment.

FIG. 13 is a sectional view of the antenna device according to the sixth embodiment. In the first embodiment, the top surface of the substrate 10 and that of the feed element 111 are exposed. In the sixth embodiment, the top surface of the substrate 10 and that of the feed element 111 are at least partially covered with a solder resist film 35. Cavities are formed in the solder resist film 35 at positions corresponding to the parasitic elements 112. Solder 30 for connecting the parasitic element 112 and the conductive pattern 21 on the dielectric member 20 is disposed within each cavity.

Advantages of the sixth embodiment will be discussed below.

In the sixth embodiment, the occurrence of an accident, such as short-circuiting between the feed element 111 and the parasitic elements 112 due to a leakage of the solder 30 in the horizontal direction, can be prevented. Moreover, the solder resist film 35 serves to protect the feed element 111, thereby reducing damage to the feed element 111.

Seventh Embodiment

A communication apparatus according to a seventh embodiment will be described below with reference to FIG. 14.

Figure 14:
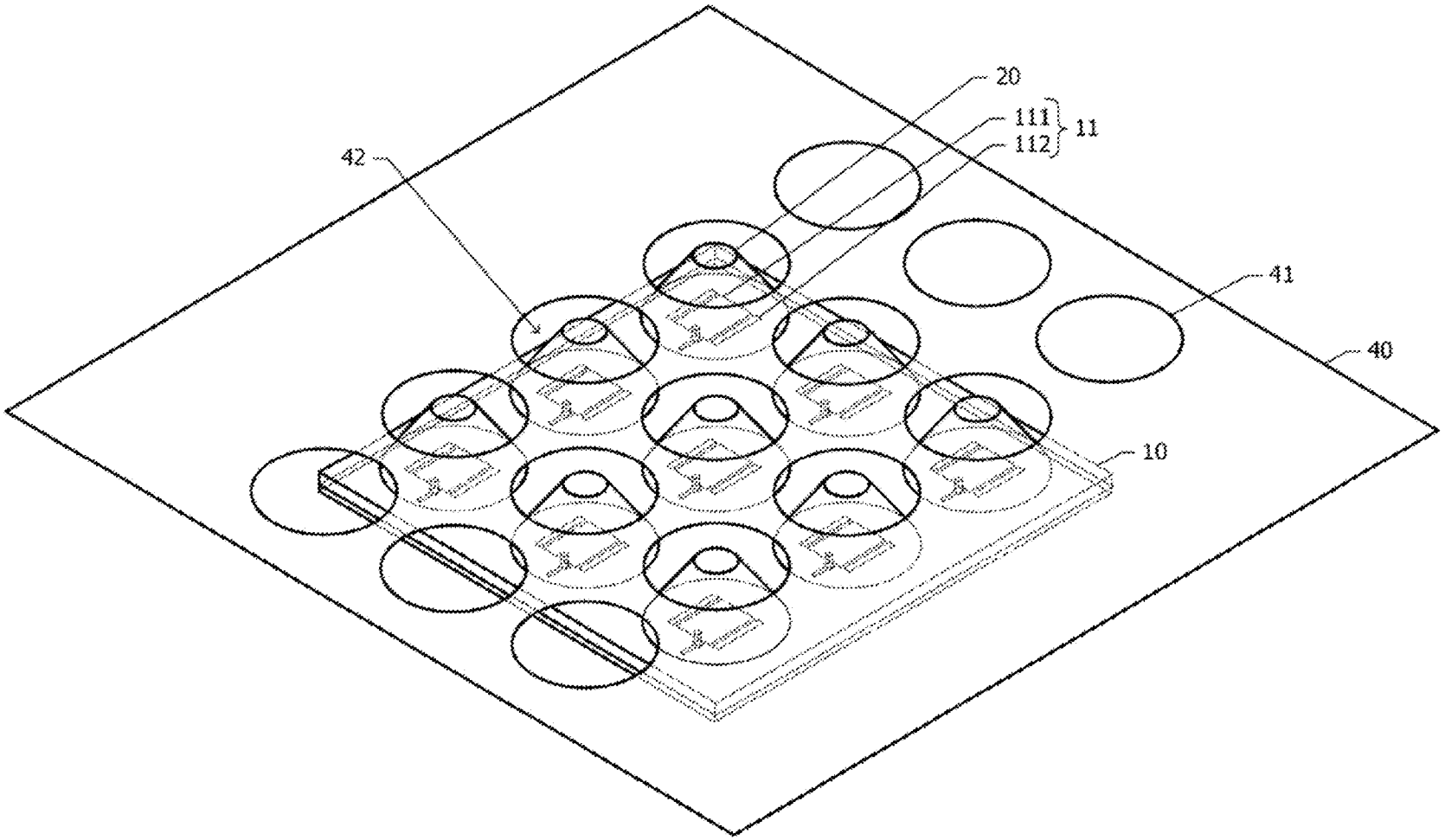
FIG. 14 is a partial perspective view of a communication apparatus according to a seventh embodiment.

FIG. 14 is a partial perspective view of the communication apparatus according to the seventh embodiment. The communication apparatus of the seventh embodiment includes a housing 40 and an antenna device 42 stored in the housing 40. In FIG. 14, only part of the housing 40 is shown.

The antenna device 42 includes a substrate 10, plural radiation elements 11 disposed on the substrate 10, and a dielectric member 20 disposed in association with each radiation element 11. The plural radiation elements 11 are arranged in a matrix of three rows and three columns, for example. Each radiation element 11 is constituted by a feed element 111 and multiple parasitic elements 112. As the radiation element 11 and the dielectric member 20, the radiation element 11 and the dielectric member 20 of the antenna device of one of the first through sixth embodiments are used.

Part of the housing 40 opposes the top surface of the substrate 10 of the antenna device 42 with a spacing therebetween. The portion of the housing 40 opposing the top surface of the substrate 10 (hereinafter such a portion will be called an antenna opposing portion) is formed of a conductive material, such as a metal. Multiple circular apertures 41 are formed at the antenna opposing portions of the housing 40. The multiple apertures 41 are located in association with the respective radiation elements 11 and each include the associated radiation element 11 therein as viewed from above. In addition to the apertures 41 provided in association with the radiation elements 11, apertures 41 may be provided for portions other than the radiation elements 11.

Advantages of the seventh embodiment will be described below.

In the seventh embodiment, radio waves emitted from the radiation elements 11 are not blocked by the housing 40 made of a metal, for example, and are instead radiated to a space outside the housing 40 via the associated apertures 41. To efficiently radiate radio waves to the outside of the housing 40, it is preferable that the apertures 41 be each formed in a size which covers a 3-dB beamwidth of the associated radiation element 11.

Modified examples of the seventh embodiment will be described below.

Although the apertures 41 are circular in the seventh embodiment, they may be formed in another shape. If beamforming is performed in a specific plane, the apertures 41 may be formed in a shape elongated in a direction parallel with the plane to be subjected to beamforming, such as an ellipse or a racetrack. In this case, one aperture 41 may be provided for plural radiation elements 11 arranged in a direction parallel with the plane to be subjected to beam-forming.

In the seventh embodiment, the apertures 41 are open, but they may be closed with the dielectric member.

The above-described embodiments are only examples. The configurations described in different embodiments may partially be replaced by or combined with each other. Similar advantages obtained by similar configurations in plural embodiments are not repeated in the individual embodiments. The present disclosure is not restricted to the above-described embodiments. It is to be understood that variations, improvements, and combinations, for example, will be apparent to those skilled in the art.

REFERENCE SIGNS LIST

10 substrate
11 radiation element
12 feed line
13 via-conductor
15 ground conductor
16 clearance hole
20 dielectric member
20L bottom surface of dielectric member
20U top surface of dielectric member
21 conductive pattern
22 parasitic element (second parasitic element)
30 solder
32 gap
35 solder resist film
40 housing
41 aperture
42 antenna device
111 feed element
112 parasitic element (first parasitic element)

The invention claimed is:

1. An antenna device comprising:
a substrate;
a feed element that is disposed at a first position on the substrate and configured to supply power;
a first parasitic element that is disposed on the substrate at a second position different from the first position of the feed element, from a plan view, and is electromagnetically coupled with the feed element;
a dielectric member that is disposed so as to at least partially cover the feed element and the first parasitic element as viewed from the plan view; and
a conductive pattern that is disposed on a surface of the dielectric member which faces the feed element and that is located at a third position at which the conductive pattern matches the first parasitic element as viewed from the plan view,
wherein the dielectric member is supported by the substrate as a result of the conductive pattern being electrically connected to the first parasitic element.

2. The antenna device according to claim 1, wherein the dielectric member is formed in a shape of a rectangular parallelepiped.

3. The antenna device according to claim 2, wherein the dielectric member includes a second parasitic element that is electromagnetically coupled with the feed element.

4. The antenna device according to claim 2, further comprising:
a solder resist film that at least partially covers a surface of the substrate on which the feed element and the first parasitic element are disposed and also at least partially covers the feed element, a cavity being in the solder resist film at a fourth position corresponding to the second position of the first parasitic element.

5. The antenna device according to claim 3, further comprising:
a solder resist film that at least partially covers a surface of the substrate on which the feed element and the first parasitic element are disposed and also at least partially covers the feed element, a cavity being in the solder resist film at a fourth position corresponding to the second position of the first parasitic element.

6. The antenna device according to claim 1, wherein the dielectric member is formed in a shape of a parallelepiped, has one surface of the dielectric member that faces and is in a parallel arrangement with the substrate and has at least two of four side surfaces of the dielectric member that tilt with respect to a plane perpendicular to a top surface of the feed element.

7. The antenna device according to claim 6, wherein the dielectric member includes a second parasitic element that is electromagnetically coupled with the feed element.

8. The antenna device according to claim 7, further comprising:
a solder resist film that at least partially covers a surface of the substrate on which the feed element and the first parasitic element are disposed and also at least partially covers the feed element, a cavity being in the solder resist film at a fourth position corresponding to the second position of the first parasitic element.

9. The antenna device according to claim 6, further comprising:
a solder resist film that at least partially covers a surface of the substrate on which the feed element and the first parasitic element are disposed and also at least partially covers the feed element, a cavity being in the solder resist film at a fourth position corresponding to the second position of the first parasitic element.

10. The antenna device according to claim 1, wherein:
the dielectric member includes
a bottom surface having a quadrilateral shape and facing the substrate,
four side surfaces continuing to edges of the bottom surfaces, and
a top surface being parallel with the bottom surface, wherein
an angle formed by the bottom surface and at least one of the four side surfaces is smaller than 90 degrees.

11. The antenna device according to claim 10, wherein the dielectric member includes a second parasitic element that is electromagnetically coupled with the feed element.

12. The antenna device according to claim 11, further comprising:
a solder resist film that at least partially covers a surface of the substrate on which the feed element and the first parasitic element are disposed and also at least partially covers the feed element, a cavity being in the solder resist film at a fourth position corresponding to the second position of the first parasitic element.

13. The antenna device according to claim 10, further comprising:
a solder resist film that at least partially covers a surface of the substrate on which the feed element and the first parasitic element are disposed and also at least partially covers the feed element, a cavity being in the solder resist film at a fourth position corresponding to the second position of the first parasitic element.

14. The antenna device according to claim 1, wherein the dielectric member includes a second parasitic element that is electromagnetically coupled with the feed element.

15. The antenna device according to claim 14, further comprising:

a solder resist film that at least partially covers a surface of the substrate on which the feed element and the first parasitic element are disposed and also at least partially covers the feed element, a cavity being in the solder resist film at a fourth position corresponding to the second position of the first parasitic element.

16. The antenna device according to claim 1, further comprising:

a solder resist film that at least partially covers a surface of the substrate on which the feed element and the first parasitic element are disposed and also at least partially covers the feed element, a cavity being in the solder resist film at a fourth position corresponding to the second position of the first parasitic element.

* * * * *